United States Patent [19]

Bellicardi et al.

[11] 4,351,782

[45] Sep. 28, 1982

[54] COLD-ENGINE STARTING AND OPERATING DEVICES FOR CARBURETORS

[75] Inventors: Francesco Bellicardi; Carlo Dall'Osso; Bruno Cavallari, all of Bologna, Italy

[73] Assignee: Weber S.p.A, Bologna, Italy

[21] Appl. No.: 225,694

[22] Filed: Jan. 16, 1981

[30] Foreign Application Priority Data

Feb. 6, 1980 [IT] Italy ..... 3329 A/80

[51] Int. Cl.[3] ..... F02M 1/10

[52] U.S. Cl. ..... 261/39 A; 261/52

[58] Field of Search ..... 261/39 A, 52

[56] References Cited

U.S. PATENT DOCUMENTS

| | | | |
|---|---|---|---|
| 3,291,462 | 12/1966 | Mennesson | 261/39 A |
| 3,575,385 | 4/1971 | Szwargulski et al. | 261/52 |
| 3,575,389 | 4/1971 | Goto et al. | 261/39 A |
| 3,740,040 | 6/1973 | Brown et al. | 261/39 A |
| 3,807,709 | 4/1974 | Suda et al. | 261/52 |
| 3,894,620 | 7/1975 | Goldberg | 188/330 |
| 3,906,911 | 9/1975 | Nakada et al. | 261/52 |
| 3,934,571 | 1/1976 | Mennesson | 261/39 A |

FOREIGN PATENT DOCUMENTS

| | | | |
|---|---|---|---|
| 2457356 | 7/1975 | Fed. Rep. of Germany | 261/52 |
| 52-1239 | 1/1977 | Japan | 261/39 A |
| 55-54652 | 4/1980 | Japan | 261/39 A |

*Primary Examiner*—Tim R. Miles

*Attorney, Agent, or Firm*—Pearne, Gordon, Sessions, McCoy & Granger

[57] ABSTRACT

A carburetor for internal combustion engines comprises, inter alia, a body tube into which the main feed circuit and the idling and progression feed circuit open.

During cold-engine starting and operation, the richness and flow rate of the mixture delivered by the carburetor has to be increased. For this purpose, choke valves disposed in the carburetor body tube upstream of the main feed circuit have been used for some time, these when closed enabling the fuel to flow from this latter feed circuit even for low air throughputs through the tube. The carburetor throttle valve is also disposed in a "fast idle" position in order to increase the mixture flow rate.

The invention generally relates to a device which controls the positions of the choke valve and throttle valve by taking account of the engine temperature, and more particularly which makes said positions entirely automatic, independently of correct use by the driver.

5 Claims, 2 Drawing Figures

COLD-ENGINE STARTING AND OPERATING DEVICES FOR CARBURETORS

BACKGROUND OF THE INVENTION

This invention relates to carburetors for internal combustion engines, and more particularly to devices which enable the richness and throughput of the mixture which feeds motor vehicle engines to be increased.

In carburetors of a known type, a throttle valve controls the mixture flow rate to be fed to the engine. In order to enrich the mixture during cold-engine starting and operation, a choke valve disposed upstream of the choke portion is urged into its closed position by a force which progressively diminishes as the engine temperature increases, starting from a relatively high value to a negligible value which enables the choke valve to be completely opened when thermal equilibrium is reached.

As the mixture richness increases, its flow rate must also suitably increases. For this purpose, it is known, during the heating-up stage, to increase the small opening of the throttle valve, and the throttle valve is progressively returned to its minimum opening position as the engine temperature rises.

Means and systems are known which operate in such a manner as to associate the value of the small opening of the throttle valve with the intensity of the closure force on the choke valve. It is also known to use temperature-sensitive elements subjected to the heating action of a fluid which represents the engine temperature, these elements containing a plastic material of low melting point, the expansion of which enables both the choke valve mechanism and the mechanism which determines the small opening of the throttle valve to be positioned.

These temperature-sensitive elements are able to completely automate the starting devices, i.e. they are automatically put into operation when the engine cools, and are de-activated when the engine heats up.

In known arrangements, the temperature-sensitive element acts on a lever pivoted on the throttle valve spindle.

As the temperature varies, the temperature-sensitive element varies the position of the lever, which in its turn varies the intensity of the closure force on the choke valve and the position of the small opening of the throttle valve.

An arrangement of this type has particular drawbacks, such as not being able to guarantee a reliably valid relationship between the intensity of the closure force on the choke valve and the small opening of the throttle valve, because of the cumulative dimensional tolerance of the members which constitute the device, this cumulative tolerance being inevitable in industrial production. Moreover, by entrusting the positioning of the small opening of the throttle valve to the lever pivoted on the throttle valve spindle, the device becomes especially subject to the dangers deriving from vibration induced by the engine.

In present-day carburetion techniques, it is required to differentiate between the temperature of complete opening of the choke valve and the temperature at which a small opening of the throttle valve greater than minimum opening has to be still maintained. This is in order to reduce excessive pollution on the one hand, and to prevent the risk of engine stoppage on the other.

The known devices proposed for this purpose use complicated configurations of members, the definition, construction, assembly and adjustment of which are particularly difficult and costly.

SUMMARY OF THE INVENTION

The object of the invention is to provide a cold-engine starting and operating device for carburetors which is of simple construction, is not subject to damage due to vibration induced by the engine, and for which the cumulative dimensional tolerance does not give rise to operational drawbacks.

The invention consists of an automatic starting device of the aforesaid type, comprising a cam lever pivotally mounted on the central portion of the carburetor body between a main throttle valve of said carburetor and a choke valve mounted eccentrically in the carburetor body tube upstream of the choke portion and pneumatically operated by a pull-rod connected with a member sensitive to the vacuum in the intake manifold downstream from the throttle valve, a mobile element of a temperature-sensitive member which heats up as the engine temperature increases, which mobile element is movable against first elastic means which are adapted to act upon said cam lever, a choke lever fixed on a spindle of said choke valve and a first lever pivotally mounted on a spindle of said throttle valve, said cam lever being pivoted in its medial extent to the carburetor body and biased to rotate by second elastic means as far as limit defined by said mobile element, respective opposite ends of said cam lever having cam contours acting separately against said choke and first levers respectively to compel them to rotate against the action of third and fourth respective elastic means in order to open said choke valve and to reduce the small opening of said throttle valve, said third elastic means being connected at one end to said choke lever and to the other end on an appendix outstanding from said cam lever.

BRIEF DESCRIPTION OF THE DRAWINGS

These and further details will be more apparent by reference to the accompanying figures given by way of non-limiting example, and in which.

DETAILED DESCRIPTION OF THE INVENTION

Figure 1:
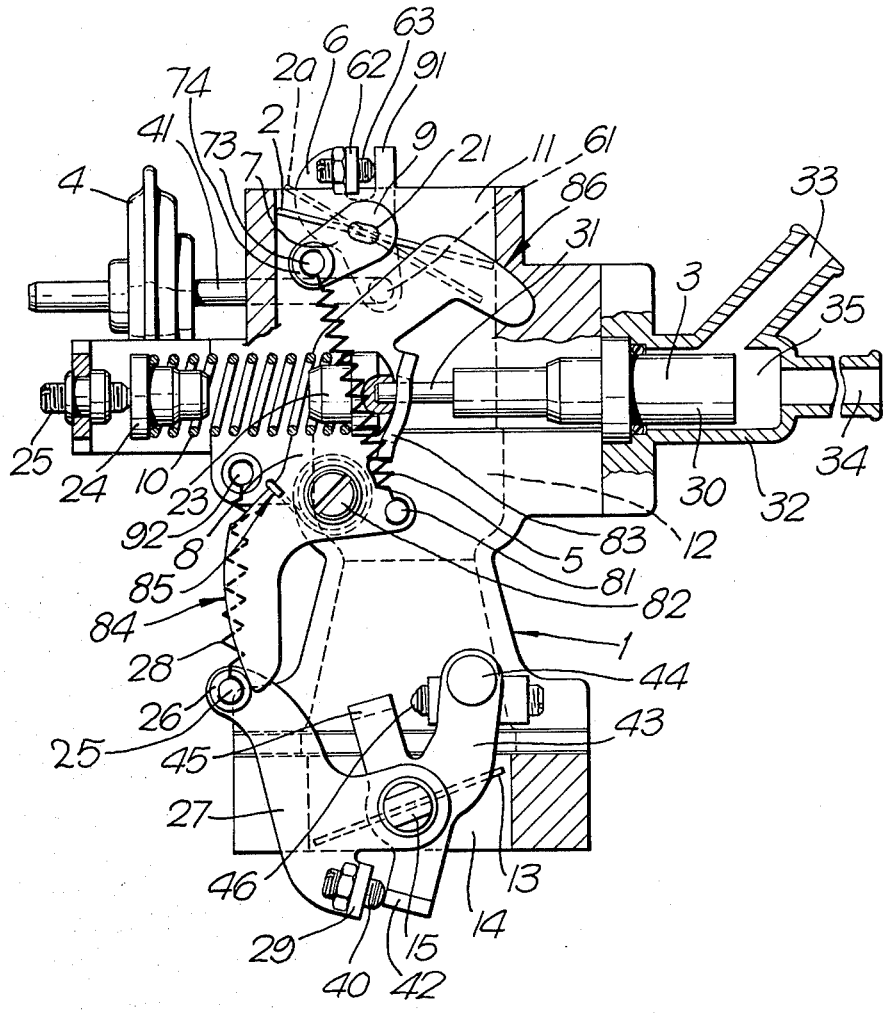
FIG. 1 shows the device according to the invention in a position which allows the engine to start and operate in its cold state.

A carburetor for internal combustion engines is constituted, inter alia, by a body tube 1 of known shape which communicates at its top 11 with the air filter and is connected at its bottom 14 to the intake manifold, not shown, located downstream of a throttle valve 13. The body tube 1 comprises a choke portion 12 in the form of a venturi into which the conventional main feed circuit, not shown, opens. The idling and progression feed circuit, not shown because of conventional type, also opens into the lower part 14 of the body tube.

The fuel delivery by the main feed circuit depends on the suction which arises in the choke zone 12. When the opening of the throttle valve 13 is small, the suction in the choke zone 12 is not sufficient to draw fuel from the main feed circuit. The purpose of the device according to the invention is to obtain a suction in the choke zone 12 which is sufficiently high, even when the throttle valve 13 is in its small opening position, to enable fuel to be delivered by the main circuit.

In this manner, the mixture is enriched as required by the engine temperature conditions.

Figure 2:
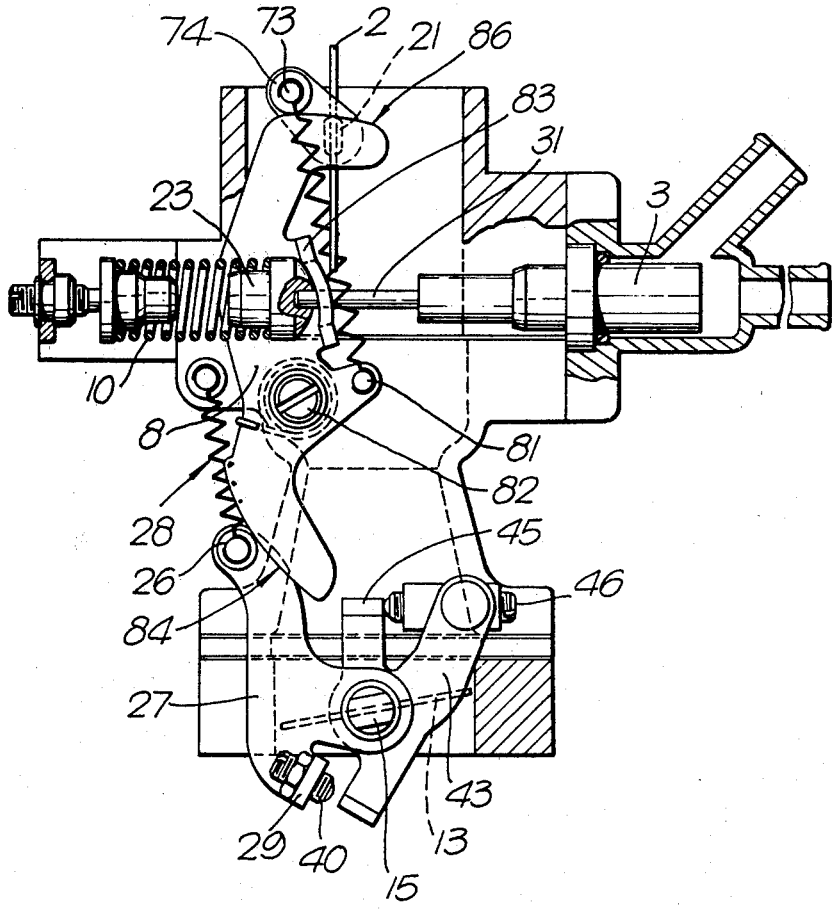
FIG. 2 shows the device according to the invention in a second position which allows the engine to operate in its hot state.

In the inlet 11 of the tube 1 there is a choke valve 2 which rotates about an eccentric spindle 21 from the completely closed position (FIG. 1) to the completely open position (FIG. 2). The consequence of closing the choke valve 2 is an increase in the suction in the choke zone 12, and thus enrichment of the mixture. The consequence of opening the choke valve 2 is the return to a "normal" suction in the choke zone 12, and thus restoration of the normal strength of the mixture delivered by the carburetor.

The position of the choke valve 2 depends on the position of a cam lever 8. If this is in the position shown in FIG. 1, the pin or appendix on lever 8, on which pin the lower end of a spring 5 is engaged, is at its maximum distance from the eccentric spindle 21. The second end of the spring 5 is engaged on a pin 73 disposed in a choke lever 7. In this manner, the spring 5 closes the choke valve 2, the spindle of which is rigid with the choke lever 7.

If the lever cam 8 is as in FIG. 2, a cam 86 disposed at the upper end of the lever 8 urges a roller 74, disposed on the pin 73, upwardly to completely open the choke valve 2. Cam lever 8 also acts on a first lever 27, as stated below.

The position of the lever 8 depends upon the engine temperature, to which an element 3 is sensitive, this being disposed in a cavity 35 through which the engine cooling liquid circulates entering through an inlet 33 and leaving through an outlet 34.

A housing 32 contains the element 3, which is a thermostatic member of known type in which a substance similar to wax undergoes a large volume change when reversibly passing from one physical state to another, and in particular from the solid state to the liquid state, between two temperature values to which it is subjected which depend upon whether the engine is cold or hot. The substance contained in a bulb 30 part of element 3 is only thermally deformable, because of which it is capable of exerting a force much higher than that of a spring 10, so limiting its stroke by means of a point 31 which is inserted into a pusher 23 on which the right hand end of the spring 10 engages.

The spring 10 is disposed between a support 24 and the pusher 23, and can be preloaded by adjusting an adjustment screw 25. The elastic force of the spring 10 is transmitted to the lever 8 because the pusher 23 rests on the right hand surface of an appendix 83 of the lever 8, which extends perpendicularly to the plane of the drawings.

In order to enable the point 31 of the temperature-sensitive element 3 to act on the pusher 23, so causing the spring 10 to be compressed, the appendix 83 is provided with a slot through which the point 31 of the element 3 extends. The point 31 is inserted into a bore provided in the pusher 23 to ensure improved rigidity between the two elements. This allows congruent movements of the three elements 31, 83, and 23, which depend only on the temperature to which the element 3 is subjected.

The lever 8 rotates about a pivot 82. It rotates progressively in an anticlockwise direction urged by a torsion spring 85, when the point 31 moves towards the left following heating of the temperature sensor 3. It rotates progressively in a clockwise direction when the point 31 moves towards the right under the action of the spring 10, as the sensor 3 cools. In the first case the force due to the sensor 3 overcomes the force of the spring 10. In the second case, the movement of the point 31 towards the right enables the spring 10 to act on the lever 8. The spring 85 provides an anticlockwise couple which is much less intense than the clockwise couple provided by the spring 10, and besides determining the anticlockwise rotation of the lever 8 due to the movement of the point 31 towards the left, it also keeps the pusher 23 adhering to the appendix 83 of the lever 8 without undergoing any separation due to engine vibration.

The device which enables the choke valve 2 to be operated comprises the choke lever 7 rigid with the spindle 21, a second lever 6 pivoted on to said spindle 21, and a lever 9 rigid with this latter and the choke lever 7.

The lever 6 comprises an eyelet 61 in which there engages the right hand end of a pull rod 41 which emerges from a pneumatic device 4, and an appendix 62 perpendicular to the plane of the drawing, which supports a screw 63 the point of which acts on an appendix 91 of the lever 9 perpendicular to the drawing.

The position of the pull rod 41 corrects the angular position of the choke valve 2 determined by the tension of the spring 5, and thus the position of the pin 81. In this respect, if the pull rod 41 is completely displaced to the right as in FIG. 1, the lever 6 is subjected to its maximum anticlockwise movement. The screw 63 is in a position withdrawn to the left such that the appendix 91, which comes into contact with the screw 63, can allow maximum anticlockwise movement of the lever 9, which constitutes the anticlockwise limiting element for the members rigid with the spindle 21.

Consequently when the pull rod 41 moves towards the left, the lever 6 rotates in a clockwise direction, because of which the screw 63 acting on the appendix 91 of the lever 9 rotates this latter in the same direction against the action of the couple provided by the spring 5, to open the choke valve through a certain extent. When setting-up the carburetor, the point of the screw 63 is positioned in such a manner as to allow closure of the choke valve 2 when the lever 8 is completely rotated clockwise, and to allow immediate action of the pneumatic device once the engine is started, by eliminating any possible slack between the levers 6 and 9.

As in the known art, the movement of the pull rod towards the left also depends in the present invention on the suction in the intake manifold. When the suction is low, the pull rod 41 is completely moved to the right; when it is high, the pull rod 41 is completely moved to the left. These positions of the pull rod 41 correspond respectively to the positions 2 and **2*a* of the choke valve 2**.

As its lower end, the lever 8 includes a cam contour 84 which cooperates with a roller 26 in order to position the first lever 27, which is pivotal on the spindle 15 of the throttle valve 13. The relative movements are as follows: when the lever 8 rotates anticlockwise, the lever 27 rotates clockwise, urged by a spring 28. In contrast, when the lever 8 rotates clockwise, the lever 27 rotates anticlockwise against the bias of the spring 28 disposed between pins 26 and 92. Pin 25 is on lever 27 and journals the roller 26, and pin 92 is on the body 1.

The lever 27 rotates from the position of FIG. 1 to that of FIG. 2 and vice versa.

When it rotates in a clockwise rotation (from the position of FIG. 1 to the position of FIG. 2), the point of a screw 40 which acts against an appendix 42 forming part of a throttle lever 43 rigid with the spindle 15 of the throttle valve 13, allows the throttle lever 43 to make a clockwise rotation under the action of the return spring, not shown. This rotation causes the progressive closure of the throttle valve 13, and continues until an appendix 45 of the lever 43 comes into contact with the point of an idling screw 46, of conventional form, and displaceable in the carburetor body 1. The point of the screw 40 enables the small opening of the throttle valve 13 to be adjusted when the lever 8 is in its maximum angular clockwise position, and thus the lever 27 is in its maximum angular anticlockwise position.

The upper end of the lever 8 comprises a second cam 86 which, when the anticlockwise rotation of the lever 8 has reached a certain extent, engages with the roller 74 on the lever 7, to cause this latter to rotate in a clockwise direction until the choke valve 2 is completely open.

The operation of the starting device according to the invention is as follows.

With reference to FIG. 1 it can be seen that the point 31 is withdrawn towards the right, so that the spring 10 keeps the lever 8 in its maximum clockwise position. The choke valve is completely closed and the throttle valve 13 is in the small closure position determined by the contact between the point of the screw 40 and the appendix 42, i.e. in the "fast idling" position.

As the engine is turned by the starting motor, the choke valve 2 undergoes alternate opening and closure movements as is known to experts of the art. The suction in the choke zone 12 is high so that the main feed circuit delivers fuel, so maintaining a rich mixture. As soon as the engine has started, the suction in the lower end 14 of the body 1 increases considerably. The suction member 4, connected to the body lower end 14, pulls the pull rod 41 towards the left, so rotating the lever 6 in a clockwise direction. The point of the screw 63 acts against the appendix 91 to rotate the lever 9 and cause the choke valve 2 to open as far as position 2*a* of FIG. 1.

This causes lean-out of the mixture, the flow rate of which is defined by the small opening of the throttle valve 13, which remains unaltered, and ensures correct idling for the thermal requirements of the engine.

If for simplicity it is assumed that the driver does not operate the accelerator connected to the throttle lever 43 by a connector 44, then the device according to the invention would adjust the position of the valves 2 and 13 to the variations in the temperature state of the engine which heats up progressively, so as to feed the engine with a mixture having the correct strength and flow rate for the successive temperature states of the engine, until normal idling is restored.

As the engine temperature increases, there is a corresponding progressive movement towards the left of the point 31, and this movement causes a progressive anticlockwise rotation of the lever 8, the consequence of which is that the support pins 81 and 73 of the spring 5 approach each other. The tension in the spring 5 reduces, to allow progressive opening of the choke valve 2.

The cam 84 simultaneously moves downwardly to allow clockwise rotation of the lever 27 under the action of the spring 28, the lever 27 following this rotation to progressively close the throttle valve 13. The configuration of the lever 8 is chosen such that the action of the cam 86 on the roller 74 of the lever 7 enables the choke valve 2 to be opened before the cam 84 returns the lever 27 into a position in which it does not act on the throttle lever 43. This enables the choke valve 2 to be completely opened before restoration of normal idling, due to the minimum opening of the throttle valve 13 as set by the screw 46 in known manner.

When the engine cools, the fluid which is in the bulb 30 contracts progressively, to withdraw the point 31 towards the right. The spring 10 progressively rotates the lever 8. This allows progressive action of the device according to the invention, with the following succession of operations: at the beginning, the small opening of the throttle valve 13 is increased, then the cam 86 is disengaged from the roller 74, and finally the small opening of the throttle valve 13 is progressively increased, with a simultaneously progressive increase in the closure of the choke valve 2, consequent on the increase in tension of the spring 5, until the configuration of FIG. 1 is restored.

The description relates to only one of the possible configurations of the invention, in which the forms, dimensions and materials do not limit the scope of the inventive idea.

What we claim is:

1. Improvements in cold-engine starting and operating devices for carburetors, consisting in an arrangement comprising a cam lever pivotally mounted on the central portion of the carburetor body between a main throttle valve of said carburetor and a choke valve mounted eccentrically in the carburetor body tube upstream of the choke portion and pneumatically operated by a pull-rod connected with a member sensitive to the vacuum in the intake manifold downstream from the throttle valve, a mobile element of a temperature-sensitive member which heats up as the engine temperature increases, which mobile element is movable against first elastic means which are adapted to act upon said cam lever, a choke lever fixed on a spindle of said choke valve and a first lever pivotally mounted on a spindle of said throttle valve, said cam lever being pivoted in its medial extent to the carburetor body and biased to rotate by second elastic means as far as a limit defined by said mobile element, respective opposite ends of said cam lever having cam contours acting separately against said choke and first lever respectively to compel them to rotate against the action of third and fourth respective elastic means in order to open said choke valve and to reduce the small opening of said throttle valve, said third elastic means being connected at one end to said choke lever and at the other end on an appendix outstanding from said cam lever.

2. Improvements in starting devices as claimed in claim 1, wherein the shape of said opposite ends of said cam lever and the shape of said cam contours are chosen such that said choke valve is compelled to be opened before said throttle valve is compelled to be closed towards its position of minimum opening.

3. Improvements in starting devices as claimed in claim 1, wherein said cam lever appendix is displaced in a position on said cam lever allowing the force exerting by said third elastic means on said choke valve to be progressively decreased owing to a rotation of said cam lever appendix toward said first lever.

4. Improvements in starting devices as claimed in claim 1, wherein said pull-rod acts on a second lever pivotally mounted on the spindle of said choke valve, said second lever being provided with a screw abutted against an appendix of said first lever in order to open said choke valve in response to a vacuum in the intake manifold downstream from said throttle valve.

5. Improvements in starting devices as claimed in claim 1, wherein said first lever has a screw acting against a throttle lever fixed to said spindle of the throttle valve, said throttle lever having an appendix adapted to cooperate with a screw displaceable in the body of the carburetor to determine the minimum opening of the throttle, and being adapted to be operated by the driver.

* * * * *